US007055571B2

(12) United States Patent
Johnston et al.

(10) Patent No.: US 7,055,571 B2
(45) Date of Patent: Jun. 6, 2006

(54) SHIELD FOR A MOVABLE BARRIER

(75) Inventors: Edward Carl Johnston, Dalton, OH (US); Dwayne Joseph Kornish, Navarre, OH (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 10/760,042

(22) Filed: Jan. 15, 2004

(65) Prior Publication Data

US 2005/0155724 A1 Jul. 21, 2005

(51) Int. Cl.
*E06B 7/16* (2006.01)

(52) U.S. Cl. ..... 160/40; 160/201; 49/197; 49/460

(58) Field of Classification Search ..... 160/40, 160/201, 229.1, 273.1, 265, 213, 133; 49/460, 49/197; 16/DIG. 1; 52/211, 717.01, DIG. 12
See application file for complete search history.

(56) References Cited

U.S. PATENT DOCUMENTS

| | | | | |
|---|---|---|---|---|
| 3,854,165 | A * | 12/1974 | Haley | 16/96 R |
| 4,016,920 | A * | 4/1977 | Shepard | 160/133 |
| 4,957,301 | A * | 9/1990 | Clay, Jr. et al. | 277/345 |
| 5,092,079 | A * | 3/1992 | Brookman et al. | 49/496.1 |
| 5,163,495 | A | 11/1992 | Lichy | 160/273.1 |
| 5,398,902 | A | 3/1995 | Crowe | |
| 5,630,459 | A | 5/1997 | Martin | 160/236 |
| 5,718,276 | A * | 2/1998 | Rekret | 160/201 |
| 5,784,834 | A * | 7/1998 | Stutzman | 49/475.1 |
| 5,887,385 | A * | 3/1999 | Horner et al. | 49/26 |
| 6,125,506 | A | 10/2000 | Martin | 16/91 |
| 6,227,281 | B1 | 5/2001 | Martin | 160/201 |
| 6,250,360 | B1 | 6/2001 | Ochoa | |
| 6,321,822 | B1 | 11/2001 | Horner et al. | 160/194 |
| 6,374,567 | B1 * | 4/2002 | Mullet | 52/716.1 |
| 6,540,003 | B1 | 4/2003 | Martin | 160/201 |
| 6,604,994 | B1 | 8/2003 | Achen | 454/271 |
| 6,672,362 | B1 * | 1/2004 | Mullet et al. | 160/201 |
| 6,772,561 | B1 * | 8/2004 | Berger, Jr. | 49/496.1 |
| 6,840,300 | B1 | 1/2005 | Lewis, Jr. | 160/201 |
| 2003/0230036 | A1 | 12/2003 | Lewis, Jr. | 52/210 |
| 2005/0133170 | A1 | 6/2005 | Hormann | |

FOREIGN PATENT DOCUMENTS

| | | |
|---|---|---|
| DE | 101 13 847 A1 | 9/2002 |
| EP | 0733766 | 9/1996 |
| WO | WO 03/087507 A1 | 7/2001 |

* cited by examiner

*Primary Examiner*—David Purol
(74) *Attorney, Agent, or Firm*—Renner Kenner Greive Bobak Taylor & Weber

(57) ABSTRACT

A door system (10) used in connection with an opening defined by a pair of jambs (11) and a laterally extending header (12) connecting the jambs, the door system including, a pair of tracks (15) mountable on the jambs, the tracks having a vertical track section (16) running adjacent the jambs, wherein a space (25) is defined between the tracks and the jambs along at least a portion of their length, a door (D) mounted for movement on the tracks and movable between an open position and a closed position, and a shield (30) mounted laterally outward of the tracks and adjacent thereto, the shield extending rearward from the jamb and overlying at least a portion of the tracks along the length of the vertical track section, wherein the overlying portion of the shield contacts the vertical track section along the length thereof.

18 Claims, 6 Drawing Sheets

SHIELD FOR A MOVABLE BARRIER

TECHNICAL FIELD

In general, the present invention relates to movable barriers, such as garage doors. In particular, the present invention relates to shielding for such movable barriers that covers the area between the movable barrier and the stationary opening to prevent insertion of objects including body parts that could become entangled and damaged.

BACKGROUND OF THE INVENTION

Movable barriers, including garage doors, raise entrapment and entanglement concerns. In particular, open spaces in and around the door and close to the moving parts of the door may allow an object to enter this open space and be entangled or entrapped by the moving parts of the door. In the past, objects within the garage including tool handles, clothing, and body parts, such as hands or fingers have been entrapped or entangled by the door. Such entanglement is a safety concern to its users and may interfere with operation of the door. To provide safer door systems, attempts have been made to prevent such entrapment.

In endeavoring to prevent entanglement or entrapment, focus has been placed on the gaps between door sections, guide rollers, and guide tracks. For example, one design available in the art provides a shield that guards the gap between the door sections to prevent entrapment of objects into the gap that forms at the sections as the door moves between the elevated open position and the lowered closed position. The shield, in this case, is configured as an outer and inner shield to prevent insertion from either side of the door. The shield is constructed of a resilient sheet material. The outer portion of the shield is formed into an L-shaped cross-section along its length with a foot portion being mounted to the upper edge of the lower door section, such that the leg portion of the L-shape extends upwardly across the gap between lower and upper door sections. A water diversion channel is formed into the foot to divert water to the ends of the door and prevent water from dripping from the door as it is raised to the open position. A pair of double faced tapes are used to secure the shield apparatus to the top edge of the lower door section. The inner shield is configured as a strip of resilient material that is mounted to the lower edge of the interface of the upper door section so that it extends downwardly across the gap between the door sections. The resiliency of the inner shield allows the inner shield to slidingly cooperate with the interface of the upper edge of the lower door section as the sectional door closes. While this device offers protection along the sectional interfacing edges of the door, it does not provide protection in the guide roller and guide track areas.

One existing roller shield design is used in connection with a sectional door. The sectional door includes a plurality of door sections hinged together in edge-to-edge relationship. Support rollers are attached to each door section and confined within a pair of support tracks located on either lateral side of the door. To prevent entrapment between the roller and the track, a circular or rectangular roller shield is mounted on the axle of each support roller outside the track. The shield is placed proximate to the track to prevent fingers from entering the track near the support rollers. In addition to the roller shields, protective shield wings are provided to enclose the support track and prevent objects from interfering with the roller as well as to provide transport guidance within the support track where the sections meet. The outer edge of the shield is blunted or protected to prevent harm during operation. Similarly, the edge of the support track includes a folded single hem used to prevent fingers from being cut as they are brushed aside by the roller shield.

To shield the area between the track and the jamb, one approach employs a track shield inserted between the track and the jamb and held in place by fasteners. Since, as is common in the art, the space between the track and the jamb varies with the height of the track, the shield must be custom fit to the particular door in order to fill the space between the track and the jamb. In this instance, the track shield has a somewhat triangular shape that narrows as it extends downwardly toward the bottom of the track. Disadvantageously, this shield design requires production and stocking of a separate custom shield for each door of varying thickness and differing track and roller designs.

In another design, track shields are used to cover the gap between the jamb and the track. Track shields have a reverse angle, such that, an inner leg lies flat against the jamb with an outer leg extending rearward from the inner leg and at a right angle. This leg extends parallel to the track between the jamb and track. While the rearwardly extending leg projects from the jamb and has tabs mounting the track, there still may be an appreciable gap between the track and the shield. Moreover, since it is a flat structure, it may have less resistance to forces that would separate the shield from the track in some areas. Since the track shields carry the weight of the tracks and door, they must be constructed of solid metal. Since they must mount the tracks, the shields are installed before hanging the door and thus, retrofitting track shields to existing doors is not a viable option with this design. Moreover, like the previously described shield, due to its construction, individual shields would have to be designed for doors of varying thickness and differing track and roller designs. Therefore, these designs do not provide a shield which adapts to all door system configurations.

SUMMARY OF THE INVENTION

Accordingly, it is an object of the present invention to provide a shield used in connection with a garage door that blocks the area between the doorjambs and the guide tracks to prevent objects from entering this area and contacting the door. Another object of the present invention is to provide such a shield for blocking the area between the door jambs and the guide tracks for doors of varying thickness and different track and roller designs. A further object of the present invention is to provide such a shield having a flexible end that deflects to engage different portions of a track section to cover different spacings between the track and the jamb. Still another object of the present invention is to provide a shield, where the portion of the shield blocking the area between the doorjambs and the guide tracks may be metallic, plastic or combinations thereof.

Another object of the present invention is to provide a shield for a garage door that blocks the area between the jambs and the guide tracks which is adapted to be easily installed with respect to new doors or the retrofit of existing doors. A further object the invention is to provide such a shield which effects at least an extent of coverage of conventional brackets which mount vertical guide tracks to prevent injury form sharp or rough surfaces on the brackets which are otherwise exposed. Yet another object of the invention is to provide such a shield which is easy to fabricate, durable and an inexpensive solution to a recognized safety concern.

In light of at least one of the foregoing objects, the present invention provides a shield used to prevent objects from entering a space between a track and a jamb in a door system, the shield including an elongate member configured to be attached laterally outwardly of the track and against the jamb, wherein the elongate member extends rearwardly from the jamb and overlies at least a portion of the track to cover the space.

The present invention further provides a door system used in connection with an opening defined by a pair of jambs and a laterally extending header connecting the jambs, the door system including a pair of tracks mountable on the jambs, the tracks having a vertical track section running adjacent the jambs, wherein a space is defined between the tracks and the jambs along at least a portion of their length, a door mounted for movement on the tracks and movable between an open position and a closed position, and a shield mounted laterally outwardly of the tracks and adjacent thereto, the shield extending rearwardly from the jamb and overlying at least a portion of the tracks along the length of the vertical track section, wherein the overlying portion of the shield contacts the vertical track section along the length thereof.

DETAILED DESCRIPTION OF THE INVENTION

A shield according to the concepts of the present invention, generally indicated by the numeral 30 in the accompanying drawings, is used in connection with a movable barrier, such as a garage door system, generally indicated by the numeral 10 in the accompanying drawings. Since the shield 30 may be used in connection with a number of door systems 10, only general reference will be made to the door systems components other than those directly involved with the shield 30.

Figure 1:
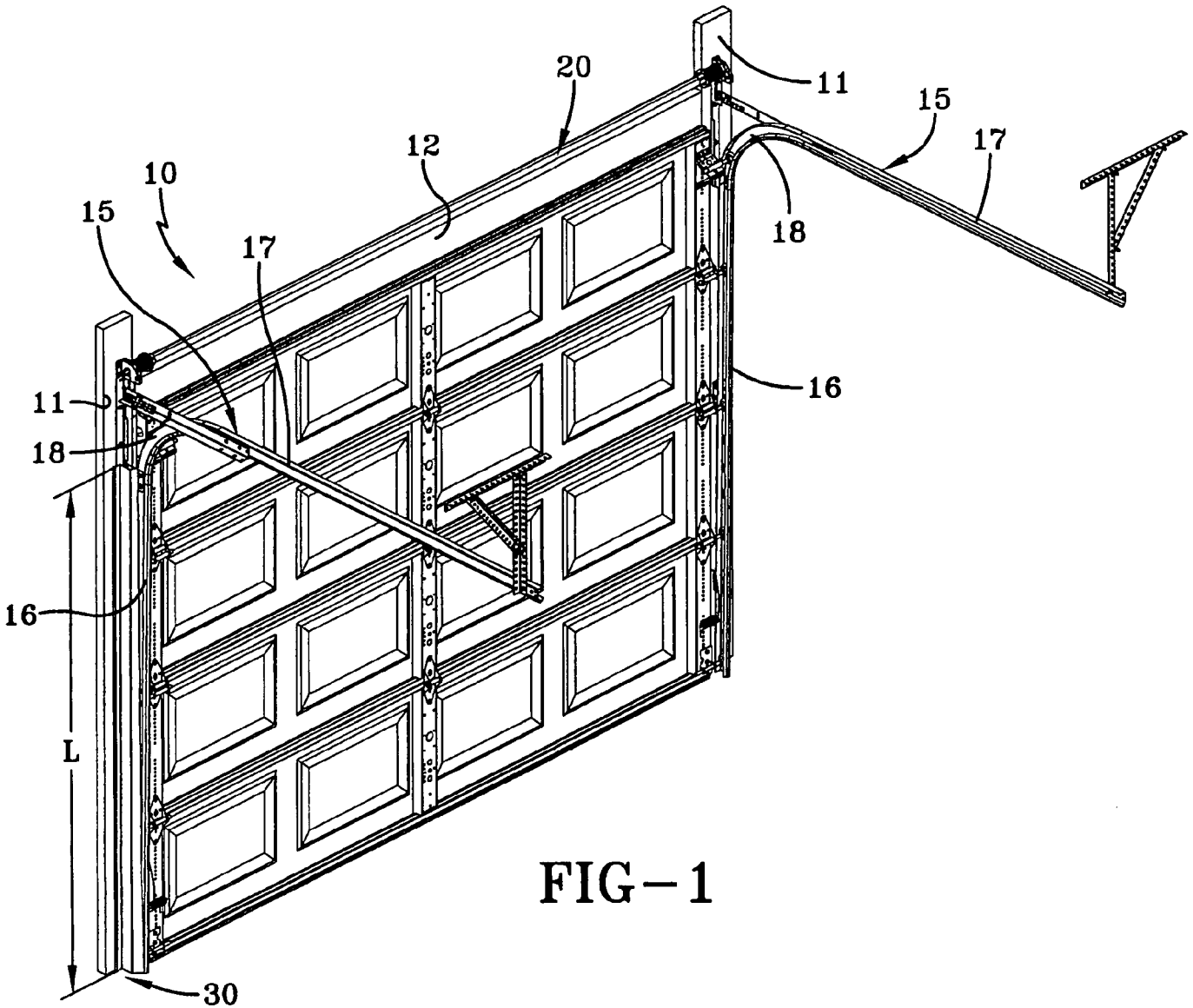
FIG. 1 is a rear perspective view of a door system mounted on guide tracks attached to the door jambs that define the door opening and a shield according to the concepts of the present invention covering the space between the guide tracks and the door jambs.
Figure 2:
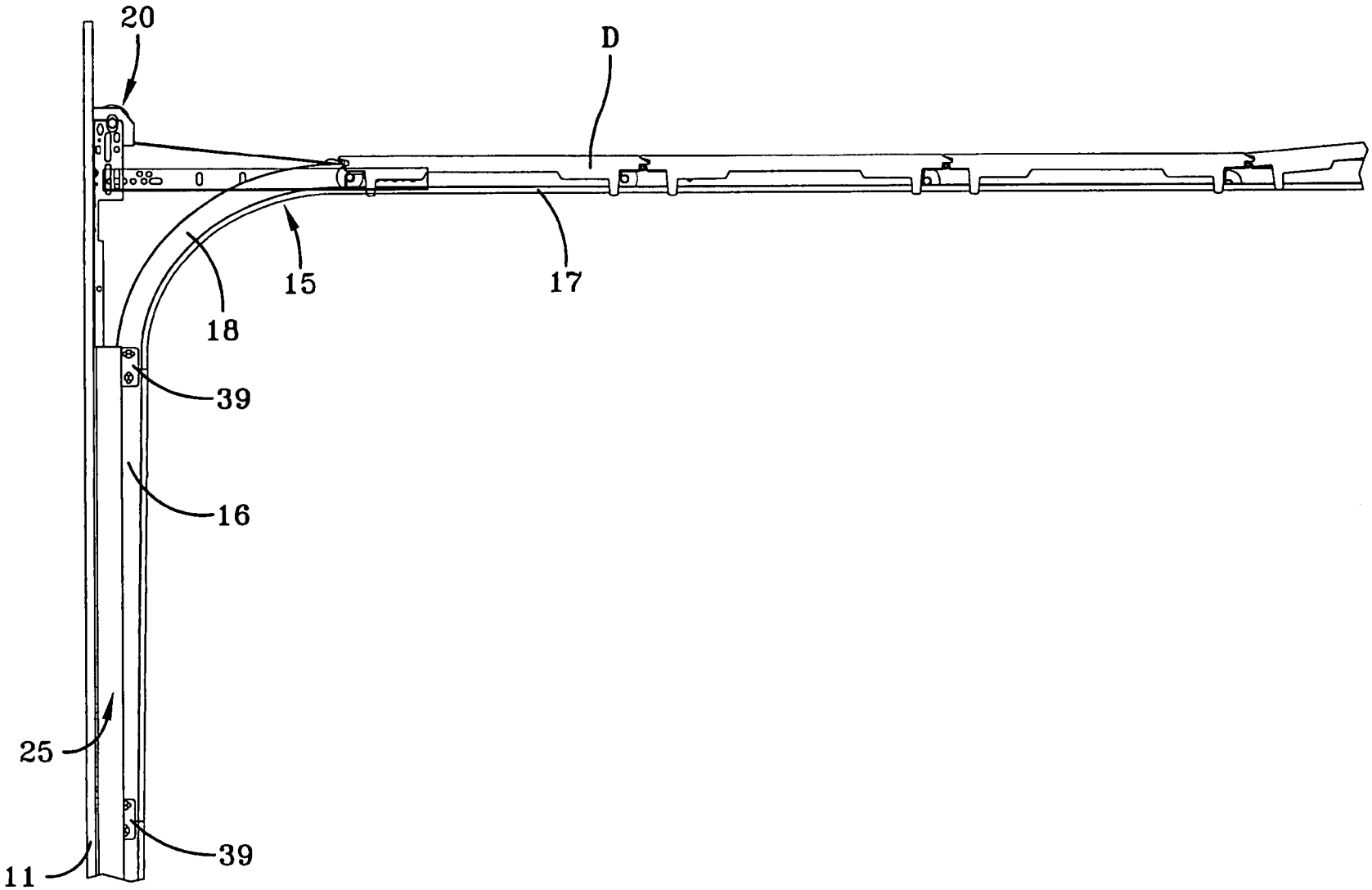
FIG. 2 is a left side end elevational view of the door system of FIG. 1 showing the space between the door jamb and the track which is covered by the shield.
Figure 3:
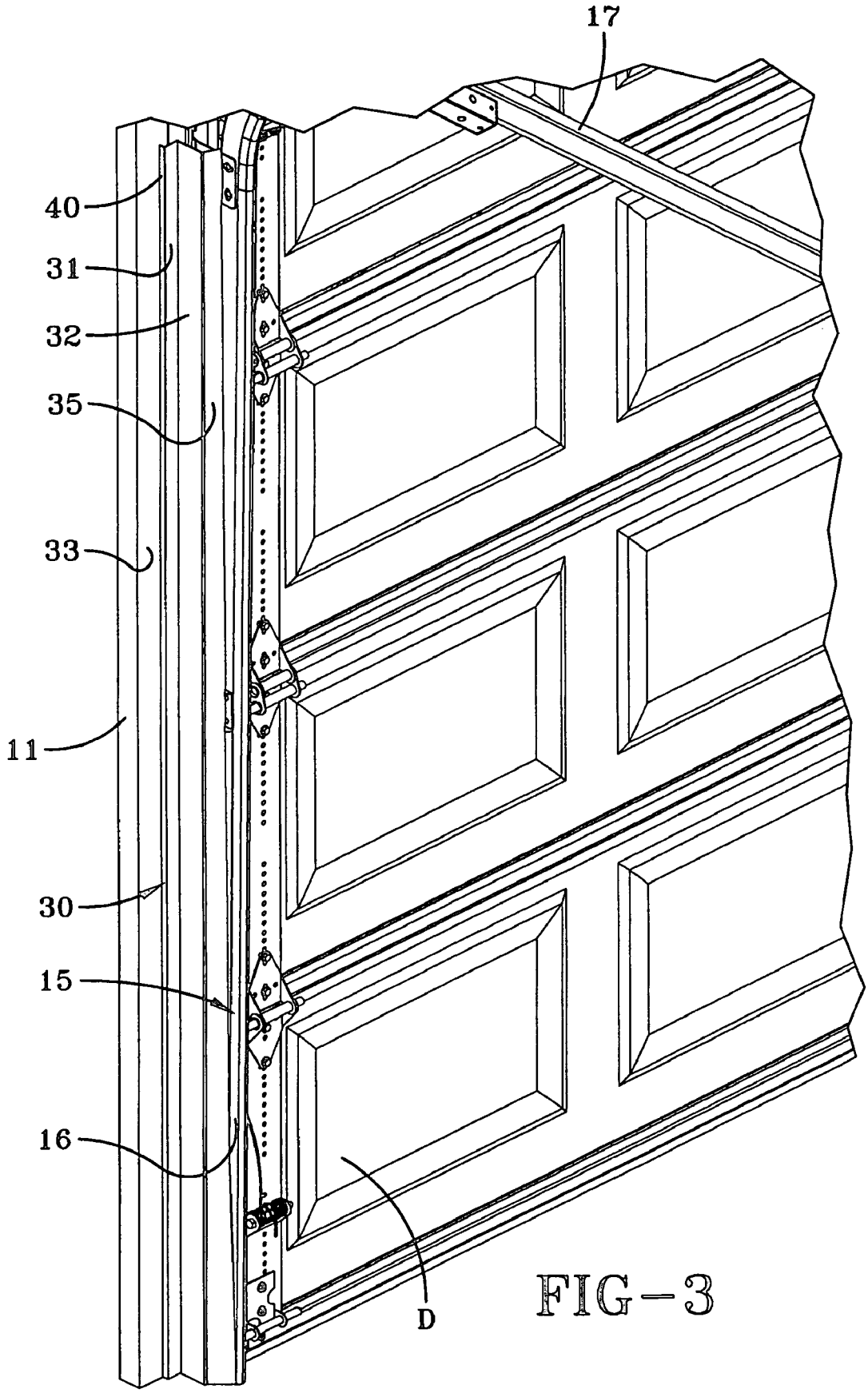
FIG. 3 is an enlarged fragmentary perspective view similar to FIG. 1, showing additional details of the shield along the length of the vertical guide track of the door.

In general, door system 10 (FIG. 1) is mounted within an opening defined by a pair of vertical jambs 11 attached by a laterally extending header 12 near the upper vertical extremity of the jambs 11. A door D resides within the opening and is moveable on a pair of guide track assemblies, generally indicated by the numeral 15, that guide the door D between a generally vertical closed position and a generally horizontal open position (not shown). To offset the weight of the door D, as it is operated on guide tracks 15, a counterbalance assembly, generally indicated by the numeral 20, may be used in connection with the door D in a manner well known in the art. Guide tracks 15 include a generally vertical track section 16 and a generally horizontal track section 17 joined by a curved transition track section 18. As best shown in FIGS. 2 and 3, the vertical track sections 16 of tracks 15 may extend or be progressively offset rearward relative to the door D as they extend upward.

As best shown in FIG. 2, a space 25 is defined between the jambs 11 and the tracks 15. As will be appreciated, objects entering this space 25 may interfere with the operation of the door D or be damaged by its movement. When the door D is in the closed position, (FIG. 1), the door D generally fills the space 25. But, when door D is raised, this space 25 becomes open presenting an opportunity for objects to enter the space 25. To prevent an object from entering this space 25, a shield, according to the concepts of the present invention, and, generally indicated by the numeral 30, is provided. Shield 30 is an elongate member that extends rearward from the jamb 11 to the track 15 covering space 25. In the example shown, shield 30 overlies a portion of track 15 completely covering space 25.

Referring to FIGS. 3–6, shield 30 may have virtually any shape capable of covering space 25. In the example shown, shield 30 generally includes an elongate L-shaped body, which may be of uniform dimensions in terms of its lateral width W, its depth T and cross-sectional configuration along its length L having a first leg 31 and a second leg 32, where the first leg 31 extends generally parallel to the face 33 of jamb 11 and laterally outward relative to the door D. First leg 31 provides a convenient surface for fastening the shield 30 to the jamb 11, as shown, for example, in FIGS. 5 and 5A. It will be appreciated that the first leg 31 may be omitted in that attachment of the shield 30 may be made at the second leg 32 or clips or tabs may be attached to the second leg 32 or jamb 11 to hold the second leg 32 relative to the jamb 11.

Figure 4:
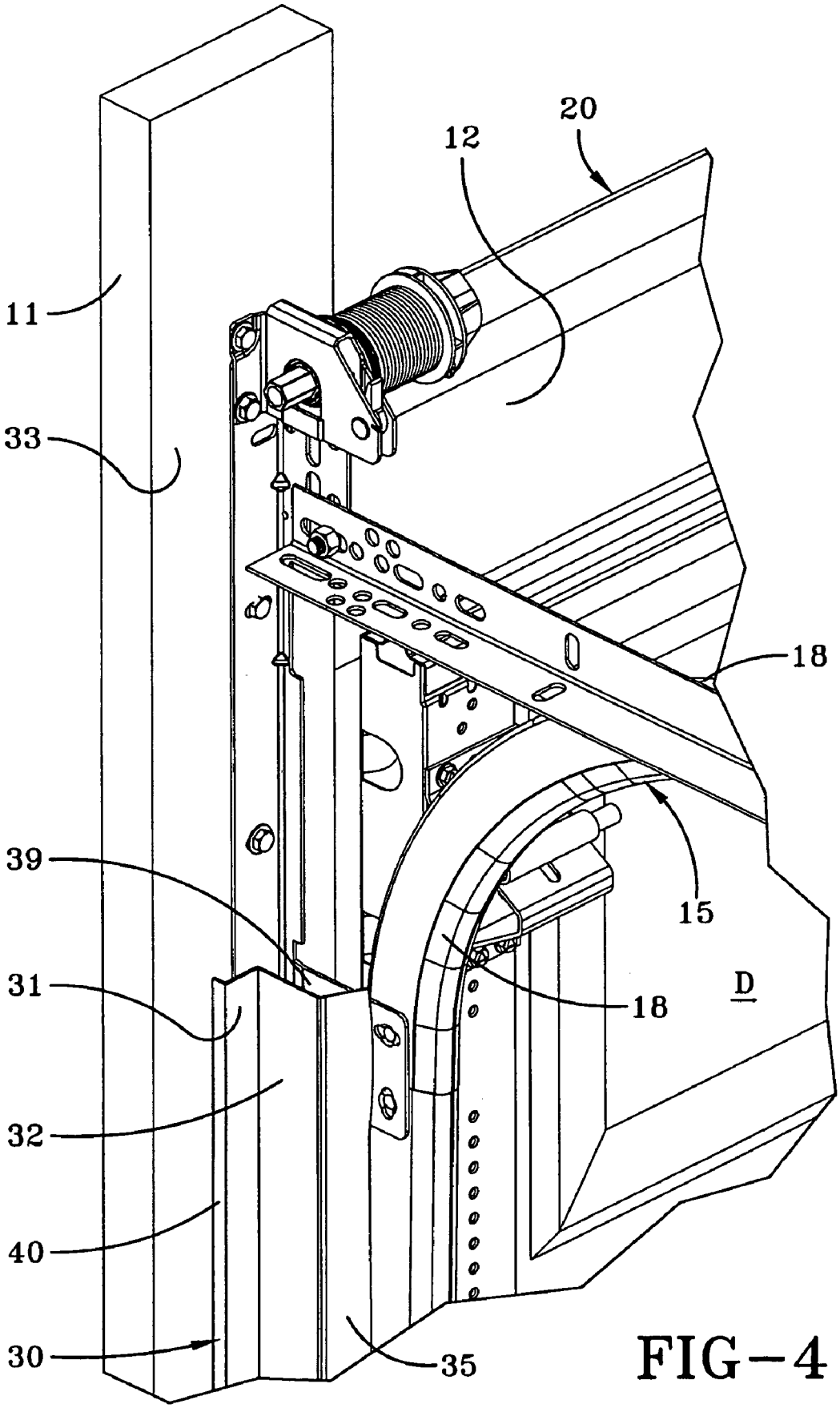
FIG. 4 is an enlarged perspective view similar to FIG. 1 showing further details of the shield near the upper extremity of the vertical guide track.
Figure 5A:
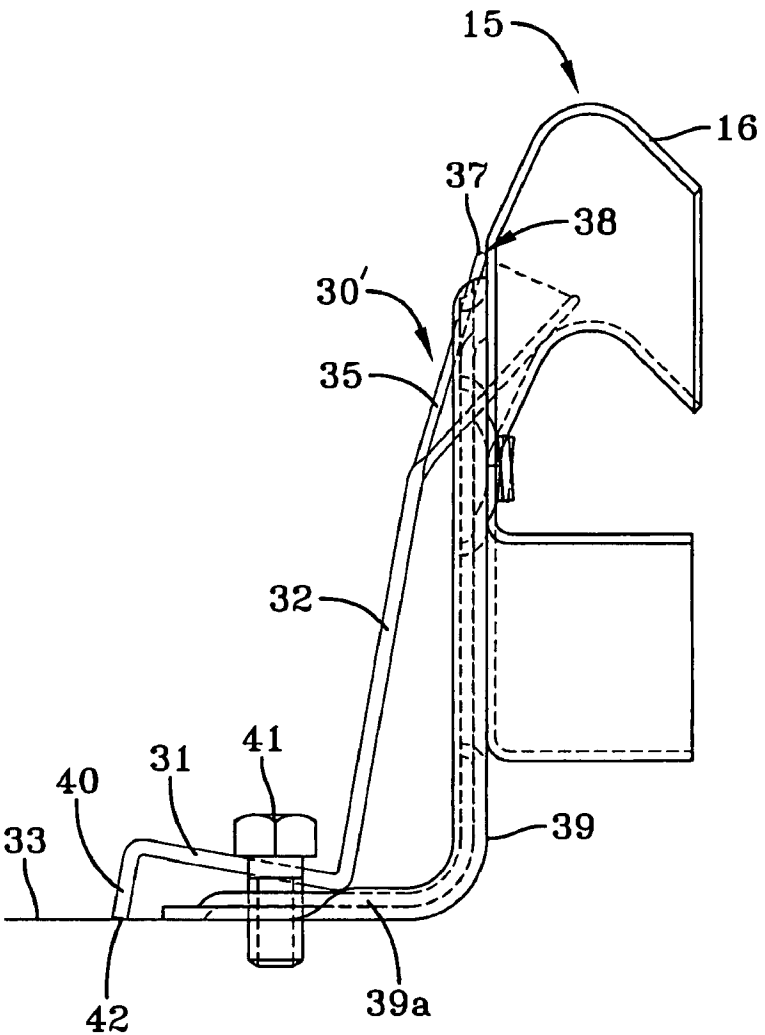
FIG. 5 and 5A are plan views of a shield according to the concepts of the present invention installed adjacent to a vertical guide track and jamb.
Figure 5:
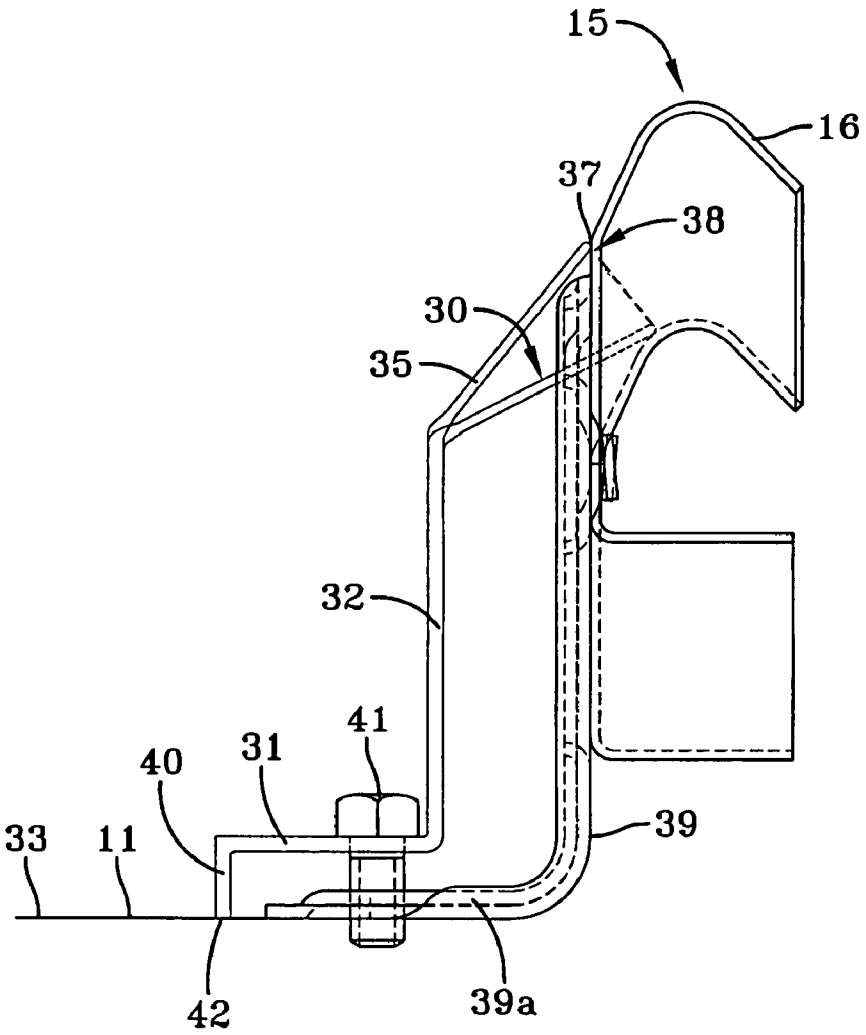
Figure 6:
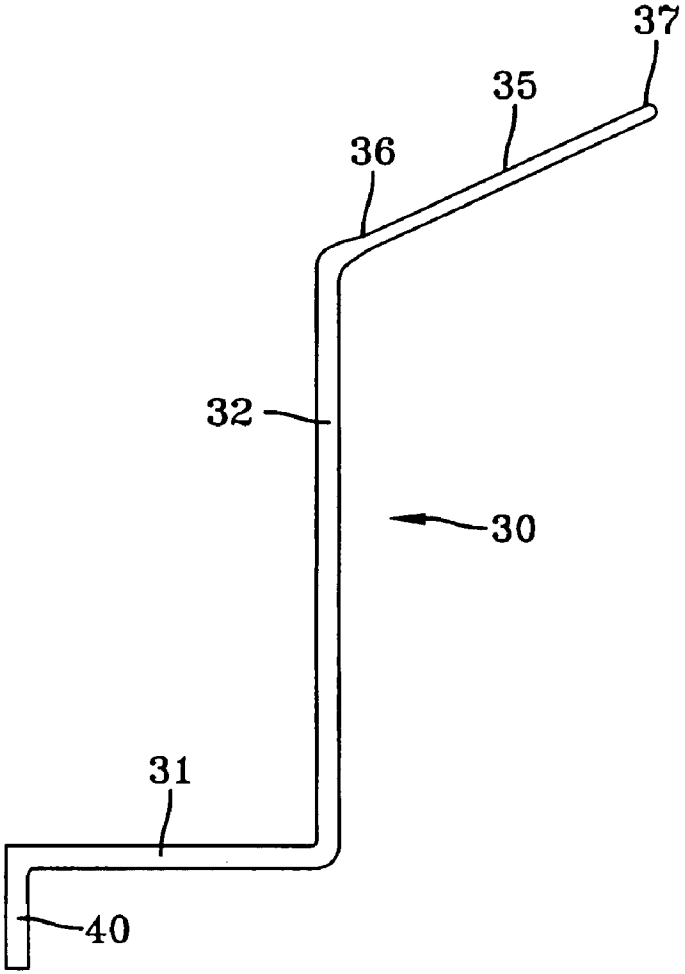
FIG. 6 is a top plan view of a shield according to the concepts of the present.

The second leg 32 extends rearward relative to the door D and may be arranged substantially perpendicularly to the first leg 31 as best shown in FIGS. 4–6. A tab 35 may extend from the rearward extremity 36 of second leg 32 toward the track assembly 15. The end 37 of tab 35 preferably overlies at least a portion of the track assembly 15 to close any space, generally indicated at 38, formed between the shield 30 and track assembly 15.

The shield 30 extends along a substantial portion of the length of the vertical track section 16 and may extend upward to cover a portion of the transition section 18 depending upon the configuration of track assembly 15. As is common in the art, the space 25 between track assembly 15 and jamb 11 may vary with a given vertical position. To account for this variation, the tab 35 may be at least somewhat flexible, such that, it may provide variable rearward extension sufficient to cover space 25. For example, tab 35 of shield 30 may be flexible and disposed at an angle relative to the second leg 32, such that it may flex inward or outward to engage different portions of vertical track section 16 in order to account for the variable extension of the track 15 relative to the jamb 11. As best shown in FIG. 2, at the lower vertical extremity of the track 15, where the track 15 is closest to the jamb, the tab 35 may extend slightly beyond the track 15 and somewhat behind it. As can be seen in FIGS. 2–4, at the lower most portion of the vertical track section 16, the space 25 is very small, and, thus, the tab 35 overlies the track 15 to a greater extent than at the uppermost portion of the vertical track section 16 (FIG. 4). As the track 15 extends rearward from the jamb 11, the tab 35 may flex inward to maintain contact with the track and overlies a lesser portion of the vertical track section 16, while continuing to cover the space 25. To provide greater flexibility proximate its end 37, the thickness of tab 35 may decrease as it extends outward from second leg 32. This increased flexibility at the end 37 improves the tab's ability to remain in pressure contact with the track assembly even in the presence of irregularities, depressions or variations in the tracks 15. It will be appreciated that the entire shield may be constructed of a nonmetallic material.

As shown, for example, in FIG. 5, the inward extension of tab 35 spaces second leg 32 laterally from the track 15 and encloses any hardware used to support the tracks 15 on the jambs 11, such as a bracket 39, as shown. This hardware often has sharp or rough edges that might injure the user or catch the user's clothing. Advantageously, by mounting the shield 30 laterally outwardly a distance relative to the tracks 15, these brackets 39 may be shielded from the user as well. To provide for any laterally extending portion of bracket 39A where attached to a jamb 11, a second tab 40 may extend forward from the first leg 31 spacing the first leg 31 rearward of any laterally extending portion 39A of bracket 39. With this arrangement, second tab 40 may also be used to selectively draw the shield 30 against the track 15, as depicted in FIG. 5A. As can be seen, second tab 40 creates a lever for the shield 30, when the shield 30 is fastened along first leg 31 to jamb 11. As depicted in FIG. 5A, a fastener 41 may be driven through first leg 31 into the jamb 11 pulling the first leg 31 toward the jamb 11 and pivoting the shield 30 about the fulcrum 42 created where the second tab 40 contacts the surface 33 of the jamb 11. In this position, shield 30 may assume the configuration, generally indicated by the numeral 30', shown in FIG. 5A. As can be seen, the fastener 41 draws the shield 30 against the track 15 and particularly, second leg 32 angles inwardly toward the track 15 and first tab 35 flexes against the track 15.

As previously mentioned, it is desirable to make the first tab 35 flexible to allow the shield 32 to adapt to variance in the track position. This flexibility also is useful in allowing the tab 35 to mold to any irregularities in surface of the track 15, such as at seams or where brackets 39 attach to the track. To provide greater flexibility, the tab 35 may have a reduced thickness relative to second leg 32, as best shown in FIG. 6. As also shown in FIG. 6, the tab 35 may taper from the second leg 32 to its end 37. Alternatively, a portion of tab 35 may be necked inward, for example, at 36, near leg 32, to reduce the thickness of tab 35 at a selected point.

Figure 7:
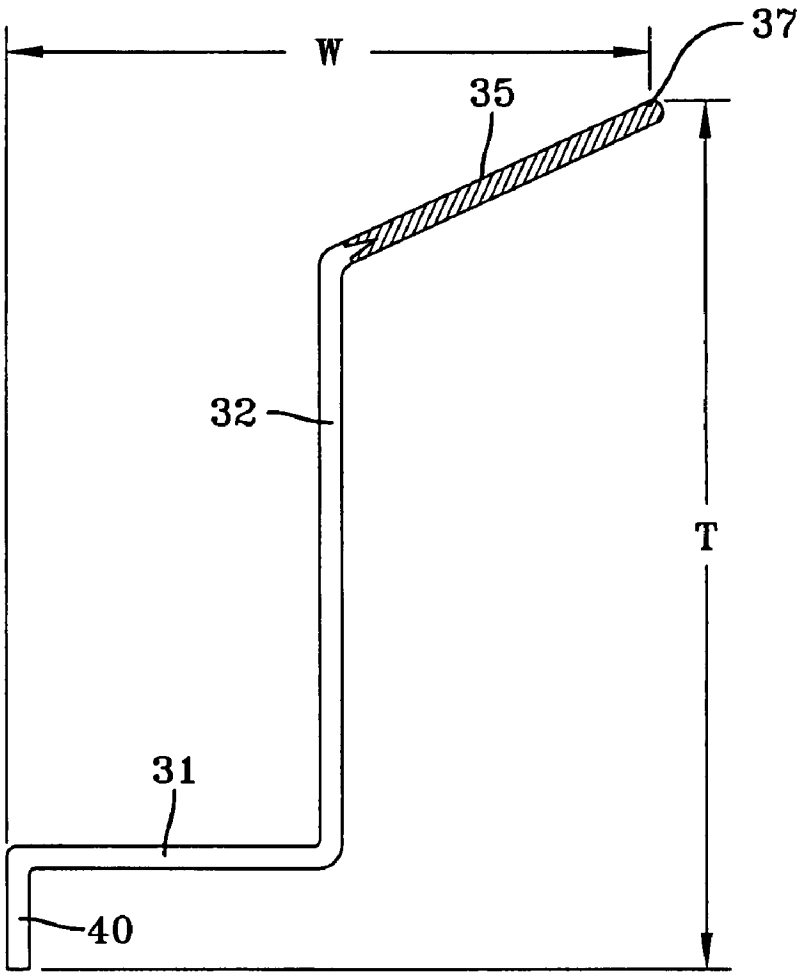
FIG. 7 is a top plan view similar to FIG. 6 depicting an alternate embodiment shield according to the concepts of the present invention having a nonmetallic portion.

The tab 35 may be made of a flexible nonmetallic material (see FIG. 7), while the body of the shield 30 may be relatively rigid. To that end, the shield 30 may have a metal body 31, 32 and non-metallic tab 35, or the shield 30 may be constructed of a dual durometer plastic. In the latter case the shield could have a rigid plastic body including legs 31, 32 and second tab 40, while the first tab 35 is a relatively flexible plastic. As will be understood from the above discussion, the shield 30 may be made of multiple pieces having different characteristics. For example, the first tab 35 may be attached to the body of the shield 30.

Since the shield 30 does not bear any of the weight of the tracks 15 or door D, it may be readily fit to existing doors as well as during new door installation. In addition, since the first tab 35 can flex to accommodate larger spaces 25 or smaller spaces 25, the shield 30 may be installed on doors having varying spacing between the jambs 11 and vertical guide tracks 16 or different size vertical tracks 16, such as when doors of different thicknesses are used. In this way, the shield 30 of the present invention does not require custom fitting and may be used with a variety of door systems. As will be appreciated, this is useful when retrofitting existing doors, which may be of a wide variety of thicknesses and styles.

Whether installing during an initial installation or retrofitting an existing door D, installation of the shield 30 is largely the same. With the door system 10 installed, the shield is placed along the lateral outward side of tracks 15 and against the jamb 11. It may be fastened in any manner including a mechanical fastener driven through the first leg 31, as best shown in FIG. 5. At least a portion of the shield 30 overlies the track 15 covering the space 25 between the track 15 and the jamb 11. Optionally, the first leg 31 may be sized such that the shield 30 covers any mounting hardware, such as brackets 39, located adjacent the track 15. Flexure of the first tab 35 against the track 15 biases the shield against the track 15 to provide a tight fit therebetween making it more difficult to pry the shield 30 away from track 15. In this way, shield 30 prevents objects from entering the space 25 between the track 15 and jamb 11 and further covers any sharp or rough surfaces on the brackets 39. In this way, users are protected from harm and the door D is protected from objects that might interfere with its operation.

Thus, it should be evident that the shield for a movable barrier disclosed herein carries out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

The invention claimed is:

1. A movable barrier system comprising, a door jamb, a guide track rearwardly offset from said door jamb to form an open space therebetween, a roller mounted door movable along said guide track between a closed position and an open position, and an elongate shield attached to said door jamb laterally outwardly of said guide track, wherein said elongate shield extends rearward from said doorjamb and overlies at least a portion of said guide track to cover said open space and wherein said elongate shield includes a first leg extending substantially parallel to said door jamb and a second leg extending rearwardly from said first leg, and a tab extending inwardly from said second leg, wherein said tab engages said guide track.

2. The movable barrier system of claim 1, wherein the part of said elongate shield overlying said guide track is flexible.

3. The movable barrier system of claim 1, wherein said tab is flexible.

4. The movable barrier system of claim 3, wherein said elongate shield is constructed entirely of metal.

5. The movable barrier system of claim 3, wherein said first leg and said second leg are constructed of metal and said tab is constructed of plastic.

6. The movable barrier system of claim 3, wherein said elongate member is constructed entirely of plastic, said first leg and said second leg being a rigid plastic and said tab being a flexible plastic.

7. The movable barrier system of claim 3 further comprising, a second tab extending forward from the lateral outward extremity of said first leg.

8. The movable barrier system of claim 3, wherein said tab extends rearward as it extends inward from said second leg.

9. The movable barrier system of claim 8, wherein said tab has an increasingly reduced thickness as it extends outward from said second leg.

10. A door system used in connection with an opening defined by a pair of jambs and a laterally extending header connecting the jambs, the door system comprising, a pair of tracks mountable on the jambs, said tracks having a vertical track section running adjacent the jambs, wherein a space is defined between said tracks and the jambs along at least a portion of their length, a door mounted for movement on said tracks and movable between an open position and a closed position, and a shield mourned laterally outward of said tracks and adjacent thereto, said shield extending rearward from the jamb and overlying at least a portion of said tracks along the length of said vertical track section, wherein said overlying portion of said shield contacts said vertical track section along said length thereof, and wherein said shield includes a first leg extending substantially parallel to and attached to the jamb and a second leg extending rearwardly from said first leg, said second leg being spaced laterally outward from said tracks and a tab extending inward from said second leg and contacting said tracks.

11. The door system of claim 10, wherein said tab is flexible.

12. The door system of claim 11, wherein said tab is constructed of a nonmetallic material.

13. The door system of claim 10 further comprising a second tab extending forward from said first leg, said second tab contacting the jamb at a fulcrum, wherein said first leg is attached to the jamb at a point laterally inwardly of said second tab.

14. The door system of claim 13, wherein said first leg is attached to the jamb by an adjustable fastener, whereby said first leg may be pivotally adjusted about said fulcrum to provide a variable pressure contact of said tab against said vertical guide section.

15. The door system of claim 13 further comprising, a mounting bracket attachable to the jamb and said track to support said track on the jamb, said first leg of said shield extending laterally outwardly beyond and enclosing said mounting bracket.

16. The door system of claim 15, wherein said mounting bracket is L-shaped with said second tab, said first leg, said second leg and said tab substantially enclosing said bracket.

17. The door system of claim 15, including a plurality of said mounting brackets attaching said vertical track section to said jamb at different distances therefrom with said tab contacting the vertical track section throughout the length thereof.

18. The door system of claim 10, wherein said shield is of uniform cross-sectional configuration along its length.

* * * * *

UNITED STATES PATENT AND TRADEMARK OFFICE

CERTIFICATE OF CORRECTION

PATENT NO. : 7,055,571 B2
APPLICATION NO. : 10/760042
DATED : June 6, 2006
INVENTOR(S) : Edward Carl Johnston and Dwayne Joseph Kornish It is certified that error appears in the above-identified patent and that said Letters Patent is hereby corrected as shown below:

In column 7, line 12 (claim 10) the word “mourned” should read --mounted--.

Signed and Sealed this

Sixth Day of November, 2007

JON W. DUDAS
*Director of the United States Patent and Trademark Office*